US005247547A

United States Patent [19]

Doig

[11] Patent Number: 5,247,547

[45] Date of Patent: Sep. 21, 1993

[54] IMPROVEMENTS IN GLOVEBOXES AND LIKE CONTAINMENTS

[75] Inventor: Raymond Doig, Tyldesley, United Kingdom

[73] Assignee: British Nuclear Fuels plc, Chesire, United Kingdom

[21] Appl. No.: 849,461

[22] Filed: Mar. 11, 1992

[30] Foreign Application Priority Data

Mar. 13, 1991 [GB] United Kingdom ..... 9105300

[51] Int. Cl.[5] ..... G21F 7/04; F15C 1/00

[52] U.S. Cl. ..... 376/314; 137/810; 137/812; 55/287

[58] Field of Search ..... 376/309, 310, 313, 314, 376/293; 55/287, 288, DIG. 9; 414/8; 454/49; 137/810, 811, 812

[56] References Cited

U.S. PATENT DOCUMENTS 3,888,556 6/1975 Strong et al. ..... 137/810
4,112,977 9/1978 Syred et al. ..... 137/812
4,422,476 12/1983 Blanchard ..... 137/810
4,584,930 4/1986 Connolly ..... 55/287

*Primary Examiner*—Daniel D. Wasil
*Attorney, Agent, or Firm*—Nixon & Vanderhye

[57] ABSTRACT

A containment, such as a glovebox (3), includes an extract system comprising an extract suction means, a filter housing (4), and a vortex amplifier (1) controlling the extent of suction by the suction means from the containment, wherein the vortex amplifier is removably mounted in an opening in a wall (2) of the containment, and the filter housing is mounted relative to the containment in such a manner that a filter (22) within the housing can be posted through an opening into the containment.

The vortex amplifier is removable for cleaning.

The filter housing may be mounted on the exterior of the containment in-line with the opening in which the vortex amplifier is mounted whereby the filter can be posted through the opening in which the vortex amplifier is mounted upon removal of the vortex amplifier.

12 Claims, 3 Drawing Sheets

IMPROVEMENTS IN GLOVEBOXES AND LIKE CONTAINMENTS

BACKGROUND OF THE INVENTION

The present invention concerns a containment, such as a glovebox, as used in the nuclear industry, in which the atmosphere in the containment must be kept isolated from the outside environment and in particular an extract system for use in connection with such a containment. Such extract systems enable the wastes and contaminants produced by operations in the containment to be extracted and filtered by suction from the containment. The pressure inside the containment is below atmospheric and this condition is known in the art as a "depression".

SUMMARY OF THE INVENTION

According to the present invention there is provided a containment, such as a glovebox, having an extract system comprising an extract suction means, a filter housing, and a vortex amplifier controlling the extent of suction by the suction means from the containment, wherein the vortex amplifier is removably mounted in an opening in a wall of the containment, and the filter housing is mounted relative to the containment in such a manner that a filter within the housing can be posted through an opening into the containment.

The vortex amplifier is removable for cleaning.

The filter housing may be mounted on the exterior of the containment in-line with the opening in which the vortex amplifier is mounted whereby the housing can be posted through the opening in which the vortex amplifier is mounted upon removal of the vortex amplifier.

In the event of a breach of the containment wall, e.g. where a rupture occurs of a glove fitted in a glove port the glove forming a part of containment wall, the depression inside containment will begin to fall as a result of the breach. The vortex amplifier compensates for this by increasing the flow from the containment into the extract system whereby the depression in the containment is maintained substantially at a predetermined level. The increased air flow over the breached area ensures that contaminants do not escape into the outside atmosphere.

Vortex amplifiers are known per se and operate by drawing a control flow from the outside atmosphere into a vortex chamber to interact with the flow from the containment being regulated. Increased flow from the containment in the emergency situation is achieved by reduction of the resistance provided by the control flow in the vortex chamber.

Desirably, the vortex amplifier has a vortex chamber and a radial diffuser acting upon the flow from its vortex chamber. The vortex amplifier may comprise a cover plate, a vortex plate and a diffuser plate each spaced from the next, the diffuser plate being co-operable with an annular member in the wall of the containment, the region between the cover plate and the vortex plate defining the vortex chamber of the amplifier.

The control flow of the vortex amplifier may be obtained via a series of equiangularly spaced plates each having an inlet channel to the vortex chamber in a direction approximately tangential to the periphery of the vortex chamber.

BRIEF DESCRIPTION OF THE DRAWINGS

Embodiments of the present invention will now be described by way of example, with reference to the accompanying drawings; in which.

DETAILED DISCUSSION OF PREFERRED EMBODIMENTS

Figure 2:
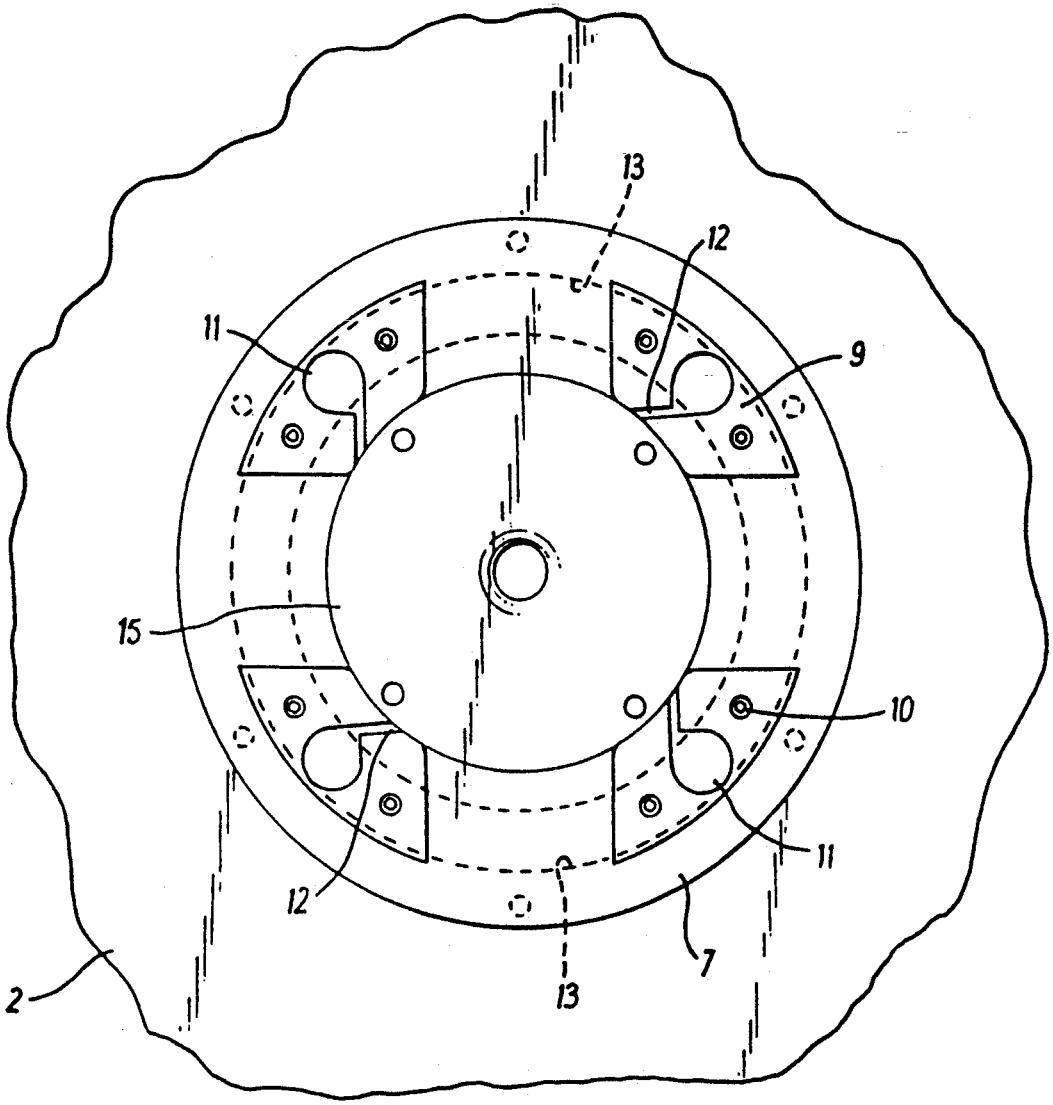
FIG. 2 is an end view, not to scale, of the extract system on the line B—B in FIG. 1.

A vortex amplifier 1 is mounted in an opening in a wall 2 of a glovebox 3. A filter housing 4 is aligned with the opening and mounted on the wall 2 on the exterior of the glovebox 3 by means of a housing flange 5. A gasket can be disposed between the wall 2 and the flange 5. The vortex amplifier 1 comprises an annular member 7 fitting within the opening in the wall 2 and secured to the housing flange by bolts 8. Four plates 9 are fixedly secured by bolts 10 to the face of the annular member 7 remote from the housing flange. The plates 9 are equiangularly spaced apart around the member 7 and each plate 9 has a channel or slot having a circular portion 11 communicating with a nozzle portion 12, the nozzle portion 12 being such as to be approximately tangential to the inner periphery of the member 7 and with each nozzle being directed in the same direction and as shown in FIG. 2. The circular portions 11 each overlie a corresponding circular aperture in the member 7 which apertures communicate with a channel 13 in the face of the member 7 abutting against the housing flange 5.

An integral unit comprising a cover plate 14, a vortex plate 15 and a diffuser plate 16 cooperates with the member 7. The cover plate 14 can be mounted on the vortex plate 15 and separated therefrom by spacers 28 which conveniently are of a length such that when the cover plate abuts against the plates 9 the vortex plate 15, which has an outer diameter equal to the inner diameter of the annular member 7, is within the annular member 7 with the faces of the vortex plate 15 and annular member 7 which face the cover plate 14 being co-planar.

In a similar manner the diffuser plate 16 can be fixedly mounted on the opposite face of the vortex plate 15 and at a fixed predetermined spacing therebetween.

The region between the cover plate 14 and the vortex plate 15 defines the vortex chamber 17 of the vortex amplifier 1. The region between the vortex plate 15 and the diffuser plate 16 constitutes a radial diffuser. A substantially conical portion 18 having a smooth streamlined surface can be arranged centrally on the cover plate 14 to face a central opening 19 in the vortex plate 15. The unit comprising the cover plate 14, vortex plate 15 and diffuser plate 16 can be releasably mounted in position by retaining knobs 20 engaging threaded studs on the member 7.

Figure 3:
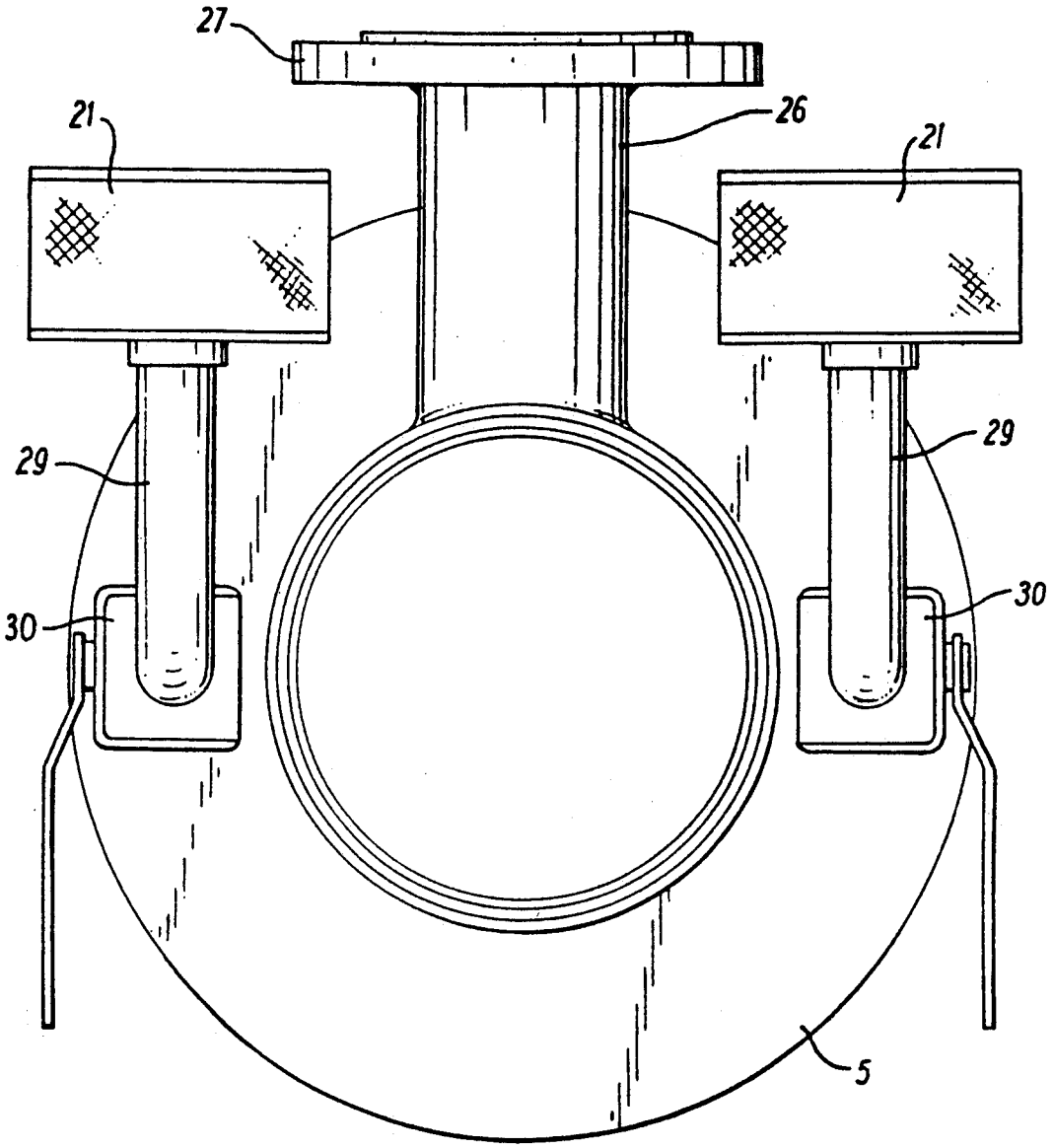
FIG. 3 is an opposite end view of the extract system.

The channel 13 in the member 7 communicates with the outside atmosphere through a pair of conduits 29 located outside the housing 4. Each conduit includes a valve 30 which can be mounted on the flange 5 and terminates in a filter 21. In the illustrated embodiment (FIG. 3) each conduit 29 has a 90° bend between the valve 30 and the filter 21. Each valve 30 can be manually adjustable.

The filter housing 4 contains a hollow cylindrical filter element 22 having a diameter less than the diameter of the housing and supported at its opposite ends by annular support members 23 which are in sliding, sealing engagement with the wall of the housing. The end of the filter element 22 facing the vortex amplifier is open whereas the opposite end of the filter element 22 is closed. The end of the housing 4 remote from the vortex amplifier 1 is sealingly closed by a removable cover 24 (omitted in FIG. 3) held in place by retaining knob 25. An outlet duct 26 having a flanged end 27 for connection to an extract line is positioned substantially at the mid-length of the housing 4.

Figure 1:
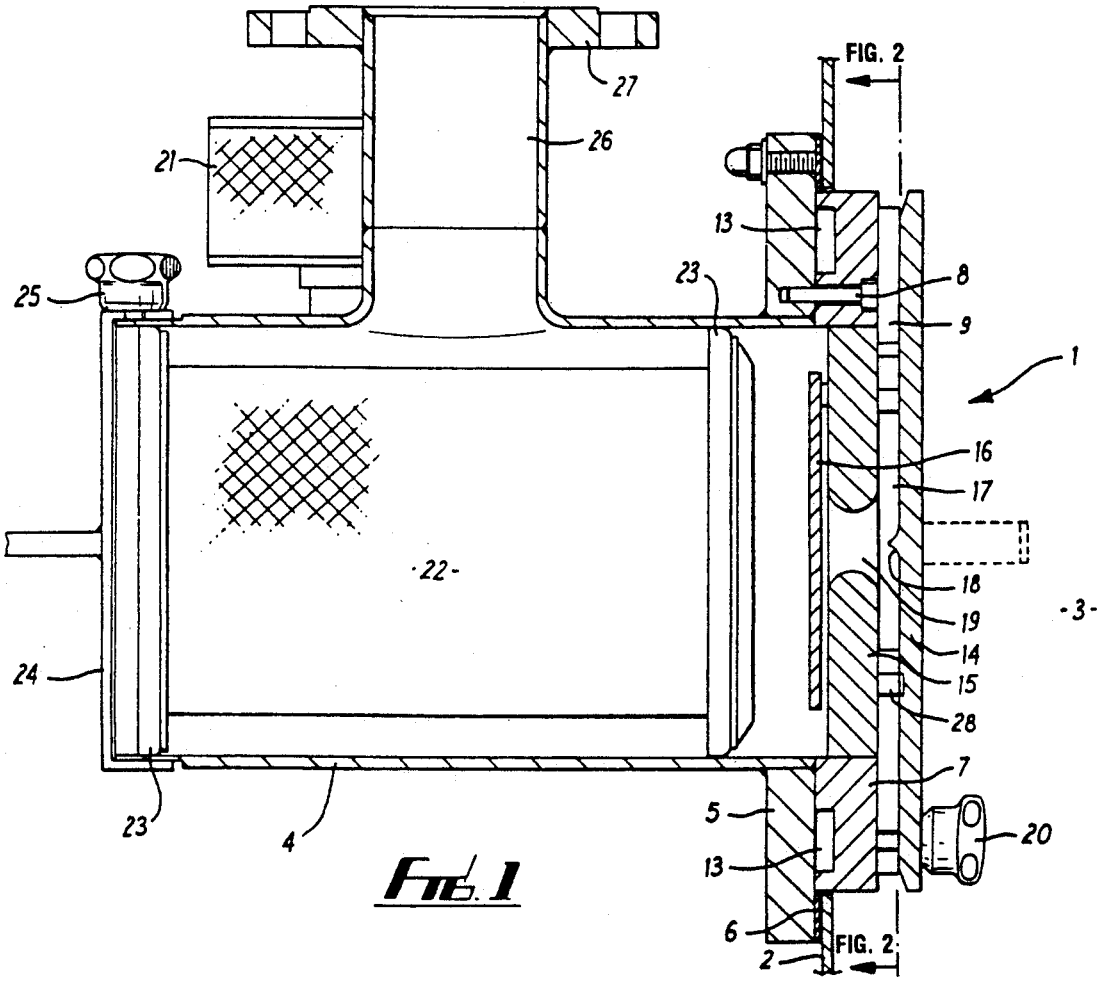
FIG. 1 is longitudinal cross-section of a glovebox extract system.

In operation and with a filter loaded into the housing 4 as shown in FIG. 1, the outlet duct 26 is connected to an extract line providing the extract suction means. In order to maintain a pre-determined depression in the glovebox 3, the depression is controlled by the vortex amplifier 1. Radial flow enters the vortex chamber 17 of the vortex amplifier 1 from the glovebox 3 by passing over the edge of the cover plate 14 and between the plates 9. Simultaneously a control flow issues at the nozzles 12 into the vortex chamber 17. The control flow is drawn from the outside atmosphere through the filters 21, conduits 29 and channel 13 in the member 7.

The control flow creates a vortex in the vortex chamber 17 to throttle the flow from the glovebox 3. The throttled flow from the vortex chamber 17 is drawn through the radial diffuser between the vortex plate 15 and the diffuser plate 16 and into the filter element 22. The flow passes through the cylindrical wall of the filter element 22 to emerge at the outlet duct 26 as a clean, filtered flow.

In the event of a breach of containment in the glovebox 3, for example a ruptured glove, a reduction occurs in depression in the glovebox 3, that is, an increase in pressure within the glovebox 3. The depression at the outlet duct 26 remains the same as before. Consequently, the resistance to the flow from the glovebox 3 provided by the control flow at the nozzles 12 is reduced, allowing increased radial flow into the vortex chamber 17 of the vortex amplifier 1 to compensate for the breach in containment.

To replace the filter element 22 the unit comprising the cover plate 14, vortex plate 15 and diffuser plate 16 is removed into the glovebox by releasing the retaining knobs 20. The cover 24 at the end of the filter housing 4 is removed to introduce a fresh replacement filter element 22 into the housing 4. In so doing, the used filter element within the housing 4 is pushed by its replacement into the glovebox 3. The end cover 24 and the vortex unit can then be re-secured in position at the opposite ends of the filter housing 4.

I claim:

1. A containment for containing a lower than atmospheric pressure, said containment having an extract system comprising:

an extract suction means, a filter housing, and a vortex amplifier controlling the extent of suction by the suction means from the containment, wherein the vortex amplifier is removably mounted in an opening in a wall of the containment and the filter housing is mounted relative to the containment in such a manner that a filter within the housing can be posted through an opening into the containment.

2. A containment as claimed in claim 1 and wherein the filter housing is mounted on the exterior of the containment in line with the opening in which the vortex amplifier is mounted whereby the filter can be posted through the opening in which the vortex amplifier is mounted upon removal of the vortex amplifier.

3. A containment as claimed in claim 1 and wherein the vortex amplifier has a vortex chamber and is characterised by a radial diffuser acting upon the flow from its vortex chamber.

4. A containment claimed in claim 1 and wherein the vortex amplifier comprises a cover plate, a vortex plate and a diffuser plate each spaced from the next, the cover plate being co-operable with an annular member in the wall of the containment, the region between the cover plate and the vortex plate defining the vortex chamber of the amplifier.

5. A containment as claimed in claim 4 and wherein a control flow in the vortex amplifier may be obtained via a series of equiangularly spaced plates each having an inlet channel to the vortex chamber in a direction approximately tangential to the periphery of the vortex chamber.

6. A containment as claimed in claim 2 and wherein the vortex amplifier has a vortex chamber and is characterised by a radial diffuser acting upon the flow from its vortex chamber.

7. A containment as claimed in claim 1, wherein said containment comprises a glovebox containment.

8. A containment as claimed in claim 7 and wherein the filter housing is mounted on the exterior of the containment in-line with the opening in which the vortex amplifier is mounted whereby the filter can be posted through the opening in which the vortex amplifier is mounted upon removal of the vortex amplifier.

9. A containment as claimed in claim 7 and wherein the vortex amplifier has a vortex chamber and is characterised by a radial diffuser acting upon the flow from its vortex chamber.

10. A containment claimed in claim 7 and wherein the vortex amplifier comprises a cover plate, a vortex plate and a diffuser plate each spaced from the next, the cover plate being co-operable with an annular member in the wall of the containment, the region between the cover plate and the vortex plate defining the vortex chamber of the amplifier.

11. A containment as claimed in claim 10 and wherein a control flow in the vortex amplifier may be obtained via a series of equiangularly spaced plates each having an inlet channel to the vortex chamber in a direction approximately tangential to the periphery of the vortex chamber.

12. A containment as claimed in claim 8 and wherein the vortex amplifier has a vortex chamber and is characterised by a radial diffuser acting upon the flow from its vortex chamber.

* * * * *